US009296032B2

(12) United States Patent
Oh et al.

(10) Patent No.: US 9,296,032 B2
(45) Date of Patent: Mar. 29, 2016

(54) METHOD OF MANUFACTURING POROUS METAL FOAM CONE ASSEMBLY HAVING HIGH SURFACE AREA

(75) Inventors: Kwon-Oh Oh, Seongnam-si (KR); Gi-Young Kim, Guri-si (KR); Jong-Kwang Kim, Seoul (KR); Deok-Su Ryu, Yongin-si (KR); Jungsuk Bae, Seoul (KR)

(73) Assignee: ALANTUM, Seongnam (KR)

( * ) Notice: Subject to any disclaimer, the term of this patent is extended or adjusted under 35 U.S.C. 154(b) by 224 days.

(21) Appl. No.: 14/003,521

(22) PCT Filed: Mar. 22, 2011

(86) PCT No.: PCT/KR2011/001940

§ 371 (c)(1),
(2), (4) Date: Sep. 6, 2013

(87) PCT Pub. No.: WO2012/121445

PCT Pub. Date: Sep. 13, 2012

(65) Prior Publication Data

US 2013/0340879 A1 Dec. 26, 2013

(30) Foreign Application Priority Data

Mar. 10, 2011 (KR) ..... 10-2011-0021573

(51) Int. Cl.

| | |
|---|---|
| ***F28F 3/06*** | (2006.01) |
| ***B21D 51/10*** | (2006.01) |
| ***B21D 5/08*** | (2006.01) |

(52) U.S. Cl.

CPC ..... *B21D 51/10* (2013.01); *B21D 5/086* (2013.01); *Y10T 29/49826* (2015.01)

(58) Field of Classification Search

CPC ..... B21D 51/10; B21D 5/086; B21D 5/08; Y10T 29/49826

See application file for complete search history.

(56) References Cited

U.S. PATENT DOCUMENTS

| | | | | |
|---|---|---|---|---|
| 4,395,900 | A | 8/1983 | Saurenman | |
| 5,766,394 | A * | 6/1998 | Anderson et al. | 156/89.11 |
| 6,216,509 | B1 | 4/2001 | Lotspaih et al. | |
| 7,785,673 | B2 * | 8/2010 | Lasko | 427/591 |
| 2003/0071147 | A1 | 4/2003 | Koshizaka | |
| 2011/0174868 | A1 * | 7/2011 | Higai et al. | 228/136 |

FOREIGN PATENT DOCUMENTS

| | | |
|---|---|---|
| CN | 1048993 | 2/1991 |
| CN | 101733338 | 6/2010 |
| JP | 06-000554 | 1/1994 |
| JP | 2000-107813 | 4/2000 |

(Continued)

*Primary Examiner* — David Bryant
*Assistant Examiner* — Jun Yoo
(74) *Attorney, Agent, or Firm* — Lex IP Meister, PLLC

(57) ABSTRACT

Disclosed is a method of manufacturing a porous metal foam cone assembly. The metal foam cone assembly according to the present invention includes providing a porous metal foam sheet; cutting the porous metal foam sheet to be in a predetermined shape using a cutting press that is provided with a knife tool; disposing the cut metal foam sheet on a base plate of a forming die and then primarily forming the metal foam sheet using a mandrel of a cone shape; secondarily forming the metal foam sheet using a left slider and a right slider of the forming die; and pressing an overlapping portion of the metal foam sheet using a stamping jig of the forming die after the forming using the left and right sliders.

4 Claims, 17 Drawing Sheets

(56) References Cited

FOREIGN PATENT DOCUMENTS

| | | |
|---|---|---|
| JP | 2006-297444 | 11/2006 |
| KR | 10-1999-0080007 | 11/1999 |
| KR | 10-2001-0072873 | 7/2001 |
| KR | 20-0248900 | 11/2001 |
| KR | 1020020014668 | 2/2002 |
| KR | 10-2003-0062825 | 7/2003 |

* cited by examiner

METHOD OF MANUFACTURING POROUS METAL FOAM CONE ASSEMBLY HAVING HIGH SURFACE AREA

TECHNICAL FIELD

The present invention relates to a porous metal foam cone assembly, and more particularly, to a method of manufacturing a porous metal foam cone assembly having a high surface area that is employed for an exhaust gas reducing apparatus.

BACKGROUND ART

A fuel injector sleeve for an internal combustion engine had some limits in manufacturing a variety of types in filtration or flame distribution. Even in the case of applying metal foam, only a roll type or a stack type in a multilayer structure was possible.

Accordingly, in order to apply various types of filtration or flame distribution, a variety of designs are required to satisfy space and performance of an internal combustion engine system. However, due to the above limits in manufacturing the variety of types, it was difficult to optimize the internal combustion engine system.

In particular, a filter is a part that is employed for a burner system in order to achieve uniform flame and to minimize fuel leakage. In the related art, there were many difficulties and limits due to a durability problem of the part in an extreme environment of high temperature.

Accordingly, there is a need for development of a product that may operate in an extreme environment.

The above information disclosed in this Background section is only for enhancement of understanding of the background of the invention and therefore it may contain information that does not form the prior art that is already known in this country to a person of ordinary skill in the art.

DISCLOSURE

Technical Problem

The present invention has been made in an effort to provide a method of manufacturing a metal foam assembly in a cone shape or a cylindrical shape using sintered metal foam having a high surface area.

Technical Solution

An exemplary embodiment of the present invention provides a method of manufacturing a porous metal foam cone, the method including: providing a porous metal foam sheet; cutting the porous metal foam sheet to be in a predetermined shape using a cutting press that is provided with a knife tool; disposing the cut metal foam sheet on a base plate of a forming die and then primarily forming the metal foam sheet using a mandrel of a cone shape; secondarily forming the metal foam sheet using a left slider and a right slider of the forming die; and pressing an overlapping portion of the metal foam sheet using a stamping jig of the forming die after the forming using the left and right sliders.

Another exemplary embodiment of the present invention provides a method of manufacturing a porous metal foam cap, the method including: providing a porous metal foam sheet; cutting the porous metal foam sheet to be in a circular shape using a cutting press that is provided with a knife tool; disposing the circular metal foam sheet on a second forming die that is mounted with an upper punch and a lower punch; and preliminarily molding the circular metal foam sheet by pressurizing the upper punch with respect to the lower punch.

Still another exemplary embodiment of the present invention provides a method of manufacturing a metal foam cone assembly, the method including: mounting the metal foam cone to an assembly jig; and disposing the metal foam cap in an upper portion of one end of the metal foam cone, and physically overlapping and thereby combining the metal foam cone and the metal foam cap by pressurizing the metal foam cap using an upper punch.

The method of manufacturing the metal foam cone assembly may further include combining a metal connector with one end of the metal foam cone assembly.

The metal connector may be combined using a connector assembly jig after applying a powder paste of powder and binder solution to the metal foam cone and the metal connector and then be sintered.

Also, the metal connector may be combined by engaging and then pressurizing one end of the metal foam cone assembly between an inner ring and the metal connector.

Also, the metal connector may be combined using spot welding after engaging one end of the metal foam cone assembly between an inner ring and the metal connector.

The porous metal foam cone assembly has a high surface area.

A fuel injector sleeve according to still another exemplary embodiment of the present invention is manufactured according to any one of the methods.

Advantageous Effects

According to the aforementioned porous metal foam cone assembly of the present invention, the following effects may be achieved.

By applying the metal foam cone assembly to the fuel injector sleeve and the like, the metal foam cone assembly may be employed to apply various types of filtration or flame distribution.

Further, in the case of employing the metal foam cone assembly for filtration, the metal foam cone assembly may be employed to be suitable for a required back pressure or efficiency by repeatedly overlapping and thereby utilizing a layer.

MODE FOR INVENTION

Figure 1:
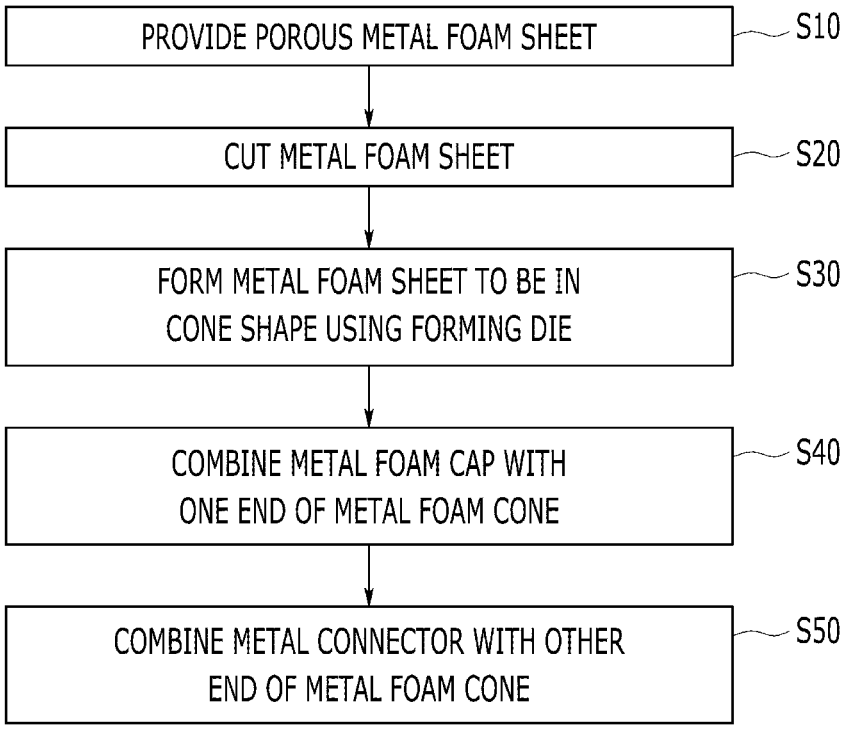
FIG. 1 is a flowchart illustrating a process of manufacturing a porous metal foam cone assembly combined with a metal connector according to the present invention.

Advantages and features of the present invention and an achieving method thereof will be clearly understood with reference to exemplary embodiments, which will be described in detail with reference to the accompanying drawings. However, the present invention is not limited to the exemplary embodiments disclosed in the following description and may be configured in different various types. Here, the present exemplary embodiments are provided to make the disclosure of the present invention complete and to completely inform those skilled in the art about the slope of the invention and thus, the present invention is defined by the claims. Like reference numerals throughout the present specification refer to like constituent elements.

Hereinafter, a method of manufacturing a porous metal foam cone assembly according to an exemplary embodiment of the present invention will be described in detail with reference to the accompanying drawings. For reference, when it is determined that a detailed description related to a known function or configuration they may render the purpose of the present invention unnecessarily ambiguous in describing the present invention, the detailed description will be omitted here.

FIG. 1 is a flowchart illustrating a process of manufacturing a porous metal foam cone assembly combined with a metal connector.

As shown in FIG. 1, a method of manufacturing a porous metal foam cone assembly according to the present invention includes providing a porous metal foam sheet (S10), cutting the metal foam sheet (S20), forming the metal foam sheet to be in a cone shape using a forming die (S30), combining a metal foam cap with one end of a metal foam cone (S40), and combining a metal connector with the other end of the metal foam cone (S50).

Figure 2:
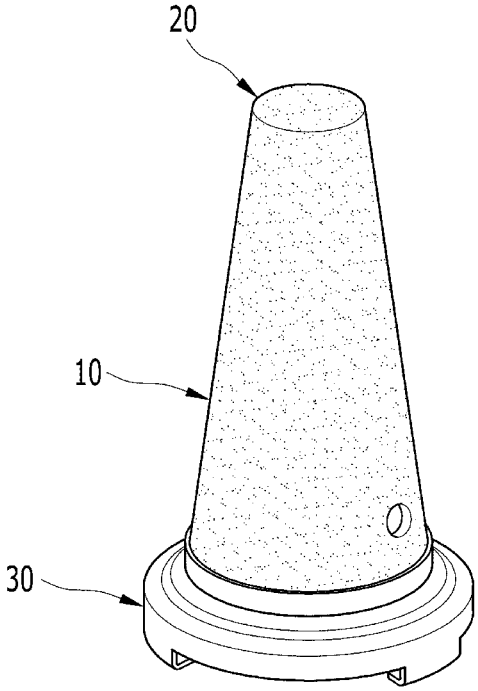
FIG. 2 is a perspective view of a porous metal foam cone assembly according to the present invention.

FIG. 2 is a perspective view of a porous metal foam cone assembly combined with a metal connector manufactured according to the present invention.

Initially, a method of manufacturing a porous metal foam cone according to an exemplary embodiment of the present invention includes providing a porous metal foam sheet; cutting the porous metal foam sheet to be in a predetermined shape using a cutting press that is provided with a knife tool; disposing the cut metal foam sheet on a base plate of a forming die and then primarily forming the metal foam sheet using a jig of a cone shape; secondarily forming the metal foam sheet using a left slider and a right slider of the forming die; and pressing an overlapping portion of the metal foam sheet using a stamping jig of the forming die after the forming using the left and right sliders.

The porous metal foam sheet may utilize a nickel-based or aluminum-based open porous metal foam sheet.

Metal foam has a cell structure that is configured as a solid metal including a hole of large volume fraction. In the case of open porous metal foam, holes form a network in which the holes are connected to each other.

The porous metal foam is cut to be into a predetermined shape using a cutting press 40 that is provided with a cutting tool or a knife tool 3 or 5. In this case, the metal foam may be cut to be in a cone shape or a cylindrical shape when the cut metal foam is rolled up.

In order to achieve a desired shape, the metal foam cut to be into the predetermined shape is disposed on a base plate 51 of a forming die 50. A face of the base plate 51 on which the metal foam is disposed may be provided in a concave shape to be rolled up in a U shape when pressurizing the metal foam from the above.

By pressurizing a mandrel 52 of a predetermined shape, desirably, a cone shape or a cylindrical shape on the metal foam disposed on the base plate 51, the mandrel 52 descends on a recess portion of the base plate 51 and the metal foam disposed between the base plate 51 and the mandrel 52 becomes to be rolled up and thereby comes into the recess portion. Accordingly, a primary shape of the metal foam is formed as a U shape.

By pushing, towards the mandrel 52, sliders 53*a* and 53*b* installed on left and right of the forming die 50 with respect to the U-shaped metal foam, the metal foam is maintained so that edge portions may be overlapped.

In this case, when the metal foam is initially cut by the cutting press 40, the metal foam is leisurely cut so that the edge portions may be overlapped by a predetermined length when the metal foam is rolled up to surround the circumference of the mandrel 52 using the left and right sliders 53*a* and 53*b*.

Further, an overlapping portion of the metal foam sheet is physically sealed by pressurizing the overlapping portion using a stamping jig 54 of the forming die 50.

The metal foam sheet may be provided as a plurality of layers and thus, a metal foam cone having a multilayer structure may be manufactured.

Further, a method of manufacturing a porous metal foam cap according to the present invention includes providing a porous metal foam sheet; cutting the porous metal foam sheet to be in a circular shape using a cutting press that is provided with a knife tool; disposing the circular metal foam sheet on a cap forming die that is mounted with an upper punch and a lower punch; and preliminarily molding the circular metal foam sheet by pressurizing the upper punch with respect to the lower punch.

The porous metal foam sheet for manufacturing the porous metal foam cap utilizes the same material as a material of the aforementioned open porous metal foam.

The metal foam sheet is cut to be into a circular shape using the cutting press 40 that is provided with the knife tool 5.

By disposing the circular metal foam on a lower punch 73 having a smooth protruding portion that has a diameter less than a diameter of the metal foam, and then pressurizing the metal foam using an upper punch 71 having a tapered recess portion, the metal foam cap in which a circumferential portion of the metal foam is uniformly bended is manufactured. Here, the tapered recess portion of the upper punch 71 has a diameter equal to or greater than the diameter of the metal foam and the diameter of the tapered recess portion decreases while getting closer to an inside.

A method of manufacturing a metal foam cone assembly according to an exemplary embodiment of the present invention includes mounting a metal foam cone 10 manufactured by the aforementioned method to an assembly jig 79, disposing a metal foam cap 20 manufactured by the aforementioned method in an upper portion of one end of the metal foam cone 10, and physically overlapping and combining the metal foam cone 10 and the metal foam cap 20 by pressurizing the metal foam cap 20 using an upper punch 77.

The metal foam cone assembly may seal the metal foam cone 10 and the metal foam cap 20 by mounting the metal foam cone 10 to the assembly jig 79 capable of receiving the metal foam cone 10, by disposing the metal foam cap 20 in an end portion of the metal foam cone 10 having a small diameter and then pressurizing the metal foam cap 20 using the upper punch 77.

The metal foam cone 10 and the metal foam cap 20 have an open porous structure. Therefore, by performing pressurization between the metal foam cone 10 and the metal foam cap 20, metal foam in a cell structure may constitute a network and thereby be mechanically sealed.

Further, the metal foam cone assembly further includes combining a metal connector 30 with one end of the metal foam cone assembly.

To be applied as a final product, the metal foam cone assembly may combine the metal connector 30 for combination with a corresponding part.

In this case, the metal connector 30 may be combined by a connector assembly jig after applying a powder paste of powder and binder solution to the metal foam cone assembly and the metal connector 30 and then be sintered.

The powder paste is produced by mixing a power material having the same or similar component to the metal foam with the binder solution. The generated powder paste is applied to a contact portion when the metal foam and the metal connector 30 are combined.

The powder paste may be produced in a slurry form by mixing nickel or nickel-based powder and polyvinylpyrrolidone solution at a predetermined ratio.

In this case, a mixture ratio of the powder to the polyvinylpyrrolidone solution may be the power of 86% to the polyvinylpyrrolidone solution of 14%. A grain size of the powder may be less than or equal to 32 μm.

Further, the polyvinylpyrrolidone solution may be produced by mixing polyvinylpyrrolidone powder with the water at a ratio of the polyvinylpyrrolidone solution of 10 g to the water of 90 g.

By mounting, to the jig, and then pressurizing the metal foam cone assembly applied with the paste and the metal connector 30, by combining and then mounting, within a furnace, the metal foam cone assembly and the metal connector 30, and by sintering the combined metal foam cone assembly and metal connector 30 at a predetermined temperature, the metal foam cone assembly and the metal connector 30 are further stably combined.

Further, the metal connector 30 may be combined by combining and then pressurizing one end of the metal foam cone assembly between an inner ring 35 and the metal connector 30.

In this case, a protruding portion 37 may be formed to be plural on the surface of the inner ring 35 to contact with the metal connector 30, along the circumference of the inner ring 35. A groove via which the protruding portion 37 of the inner ring 35 may pass is formed in a corresponding portion of the metal connector 30 to contact with the inner ring 35.

By combining all of the inner ring 35, the metal foam assembly, and the metal connector 30 and then pressurizing the protruding portion 37 of the inner ring 35 to a groove portion of the metal connector 30, the protruding portion 37 of the inner ring 35 is compressed to an outside of the metal connector 30 whereby the inner ring 35, the metal foam assembly, and the metal connector 30 are stably combined.

Further, combining of the metal connector 30 may combine parts by combining one end of the metal foam cone assembly between the inner ring 35 and the metal connector 30 and then spot welding the inner ring 35 and the metal connector 30.

By applying the methods, it is possible to manufacture a porous metal foam cone assembly having a high surface area.

By applying the methods, it is possible to manufacture a fuel injector sleeve. That is, the porous metal foam cone assembly combined with the metal connector 30 may be applied to the fuel injector sleeve.

Hereinafter, a method of manufacturing a porous metal foam cone assembly will be described in detail with reference to Examples. Here, the following Examples are only illustrative for the present invention, and a description of the present invention is not limited to the following Examples.

EXAMPLE 1

Method of Manufacturing a Metal Foam Cone Assembly

FIGS. 3 to 6 are views illustrating a process of cutting a porous metal foam cap and a porous metal foam cone according to the present invention.

Figure 3:
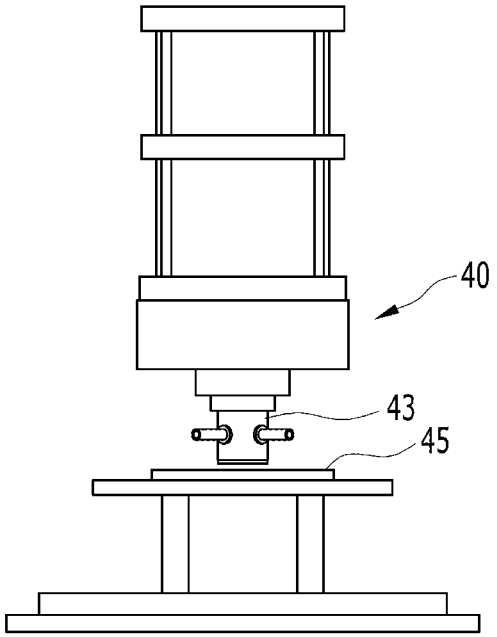
FIGS. 3 to 6 are views illustrating a process of cutting a porous metal foam cap and a porous metal foam cone according to the present invention.
Figure 4:
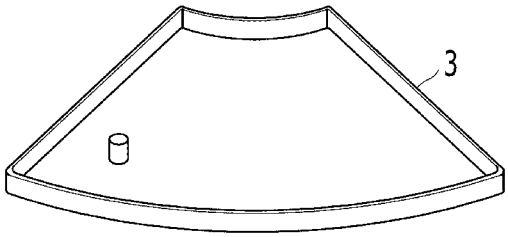
Figure 5:
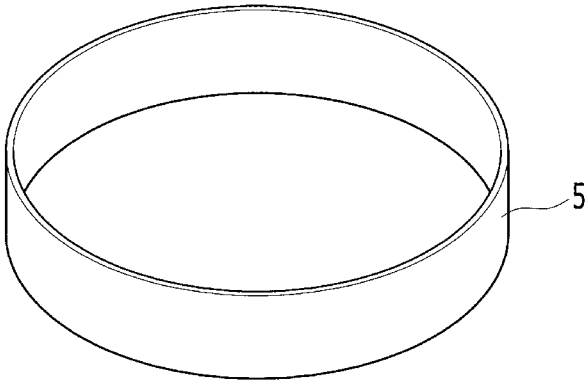

FIG. 3 illustrates a cutting press of metal foam, and FIGS. 4 and 5 illustrate a shape of the knife tool 5 to cut the metal foam in a cone shape and a circular shape, respectively.

Figure 6:
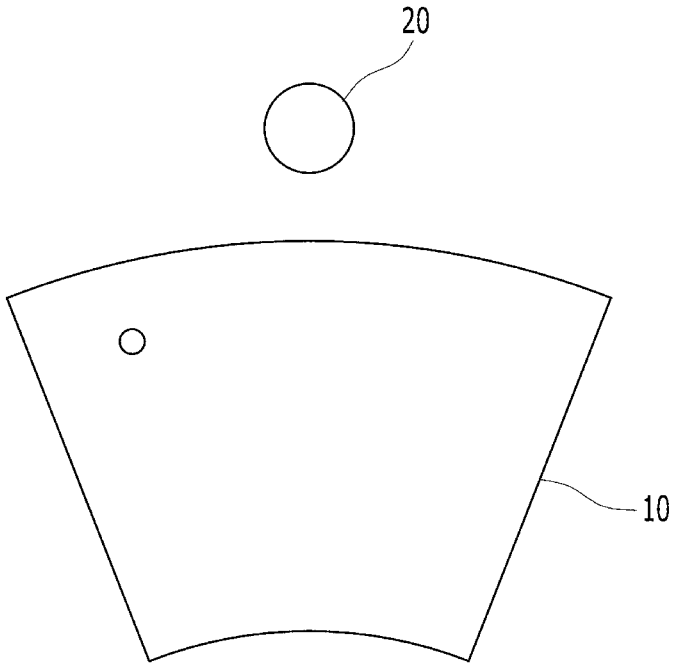

FIG. 6 is a view illustrating the metal foam cone 10 and the metal foam cap 20 cut using the cutting press 40 provided with the knife tool 5.

Figure 7:
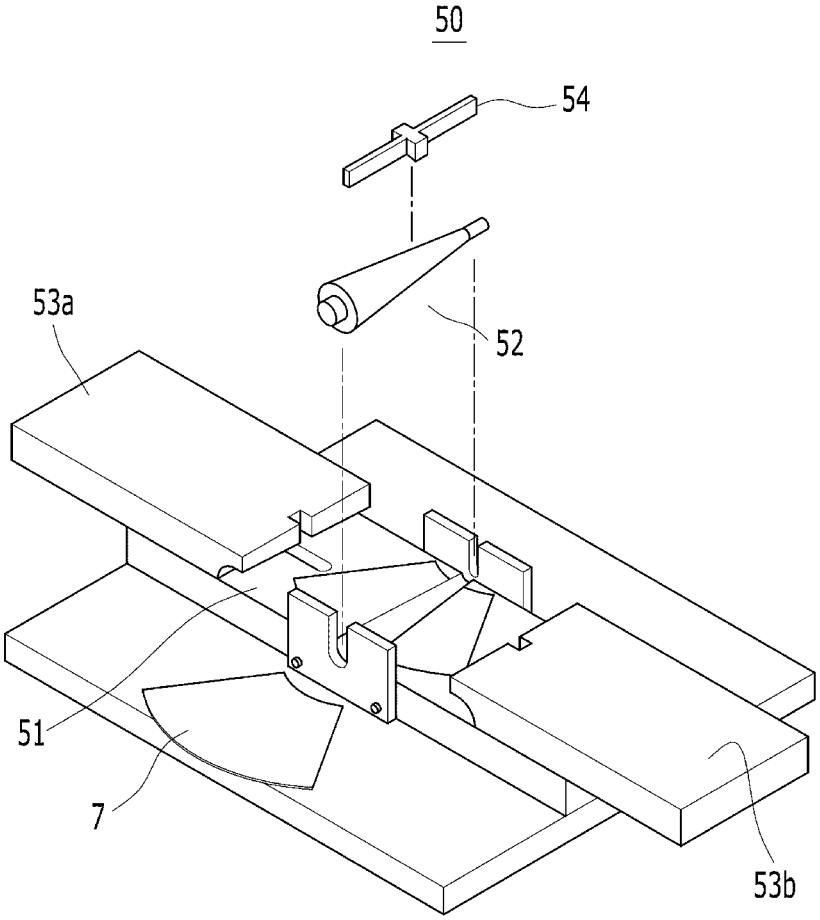
FIGS. 7 to 11 are views illustrating a process of manufacturing a porous metal foam cone according to the present invention.

FIG. 7 is a view illustrating the forming die 50 to manufacture a rolled-up metal foam cone in a shape of the mandrel 52 using the cut preliminary metal foam cone 10. A preliminary metal foam cone 7 is disposed between the mandrel 52 and the base plate 51.

A concave groove into which the mandrel 52 and the preliminary metal foam cone 7 may be inserted is formed in the base plate 51 on which the preliminary metal foam cone 7 is disposed.

Figure 8:
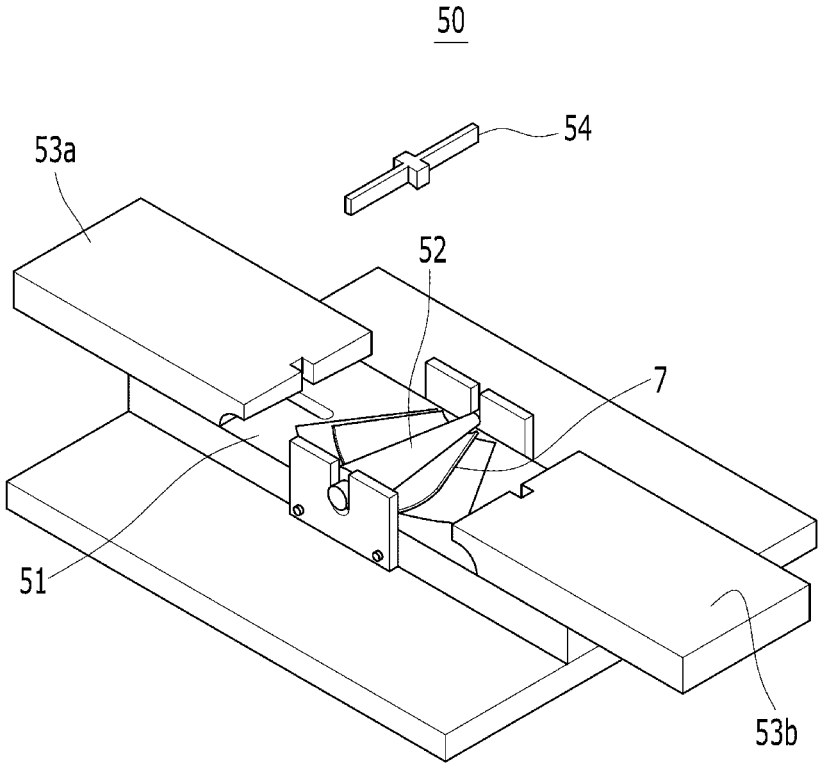

FIG. 8 is a view illustrating a process of rolling up the preliminary metal foam cone 7 in a U shape and thereby primarily molding the preliminary metal foam cone 7 by loading the preliminary metal foam cone 7 and then pressurizing the mandrel 52, and by pulling the preliminary metal foam cone 7 and the mandrel 52 in the recess portion formed in the base plate 51.

Figure 9:
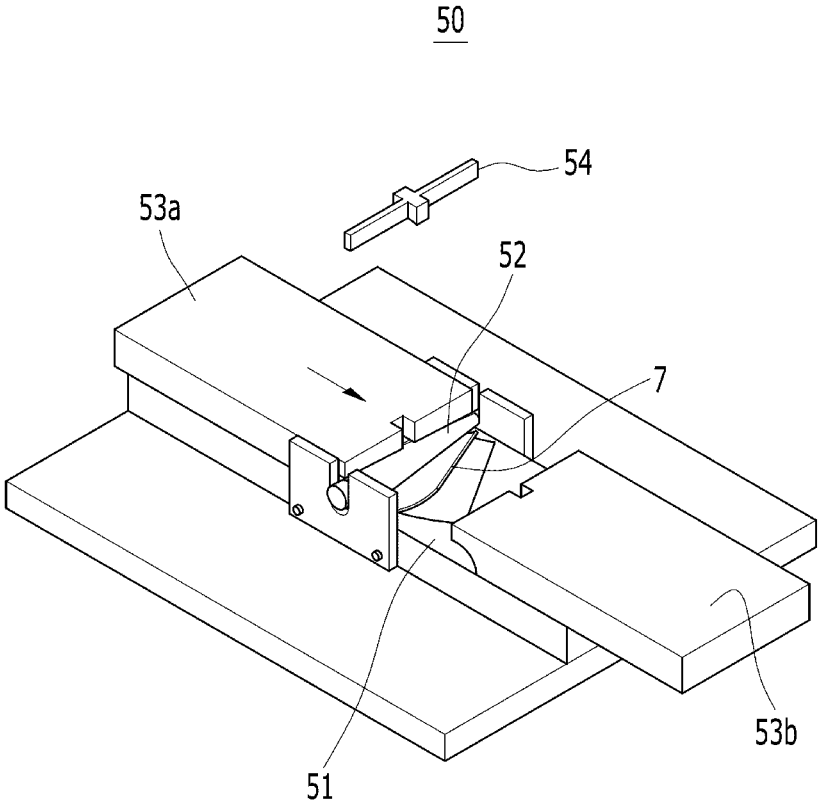

FIG. 9 is a view illustrating a process of molding the preliminarily molded metal foam cone 7 in a shape of the mandrel 52 by pressurizing, towards the mandrel 52, the left and right sliders 53*a* and 53*b* mounted on the forming die 50.

In this case, when the preliminary metal foam cone 7 is formed in the shape of the mandrel 52 along the circumferential portion of the mandrel 52 using the left and right sliders 53*a* and 53*b*, an edge of any one side of a boundary portion of the metal foam to be rolled up by the left and right sliders 53*a* and 53*b* passes an edge of the other side thereof to thereby be overlapped.

In order to form the overlapping portion, when cutting the initial preliminary metal foam cone 7, the initial preliminary metal foam cone 7 is leisurely cut so that the overlapping portion may be formed.

Figure 10:
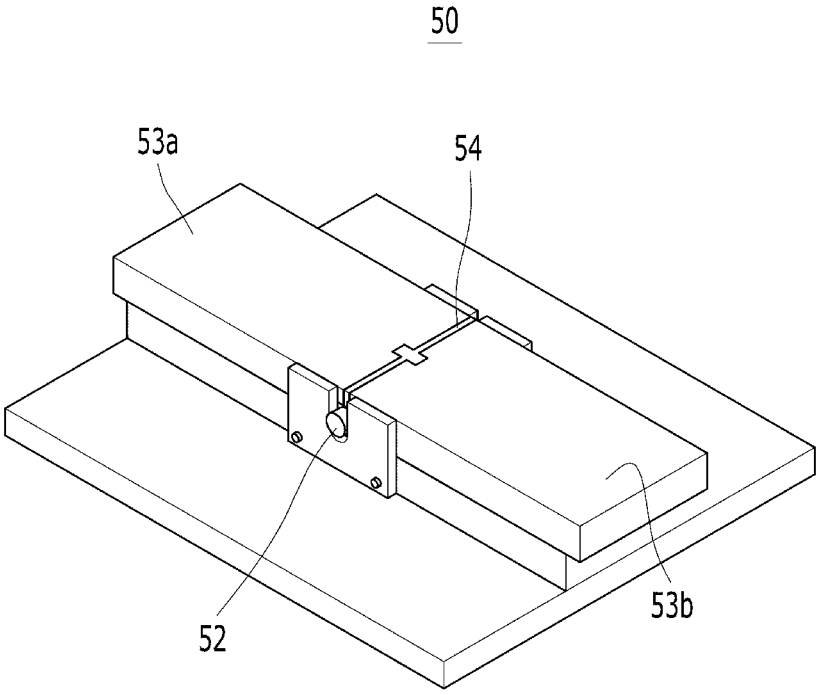

FIG. 10 is a view illustrating a process of sealing the overlapping portion of the metal foam by pressurizing the overlapping portion using the stamping jig 54.

Figure 11:
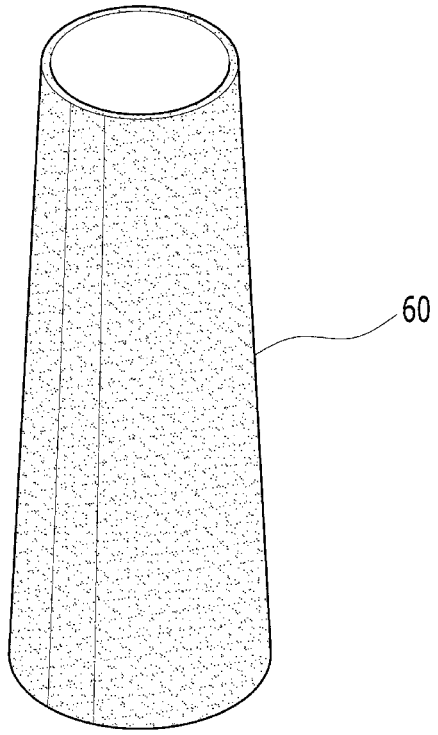

FIG. 11 is a view illustrating a metal foam 60 in a cone shape formed by the forming die 50.

EXAMPLE 2

Figure 12:
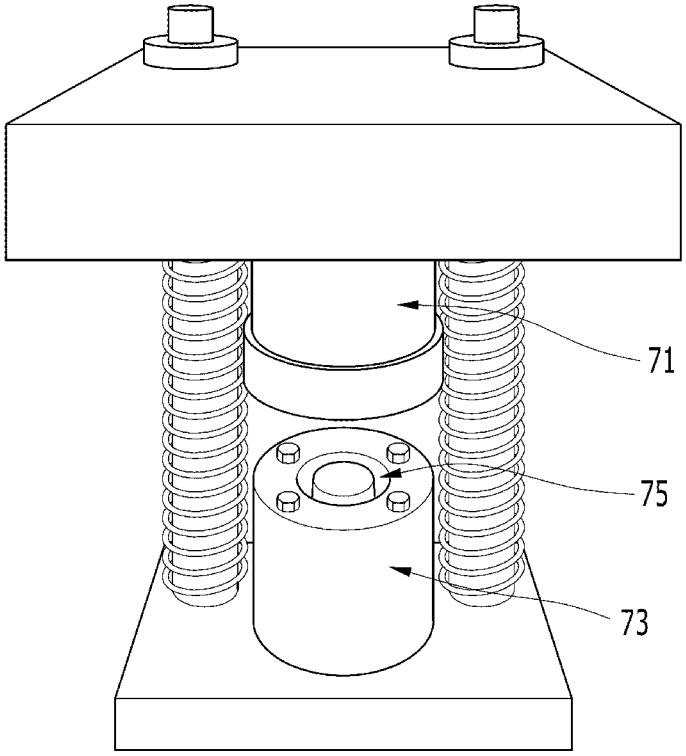
FIGS. 12 to 15 are views illustrating a process of manufacturing a metal foam cone assembly by preliminarily forming a porous metal foam cap and by combining a metal foam cone and the porous metal foam cap according to the present invention.
Figure 13:
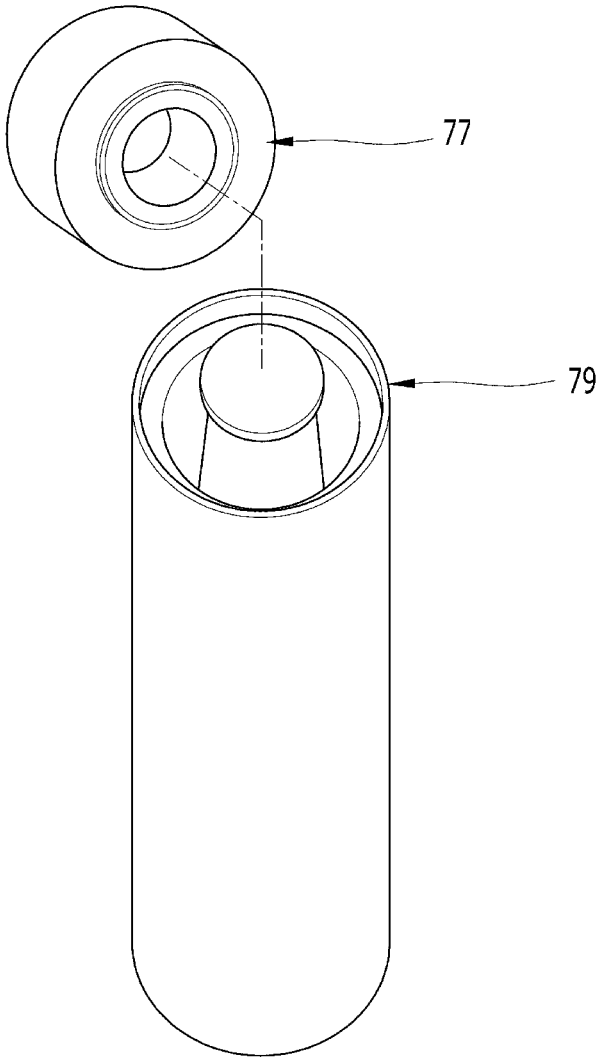
Figure 14:
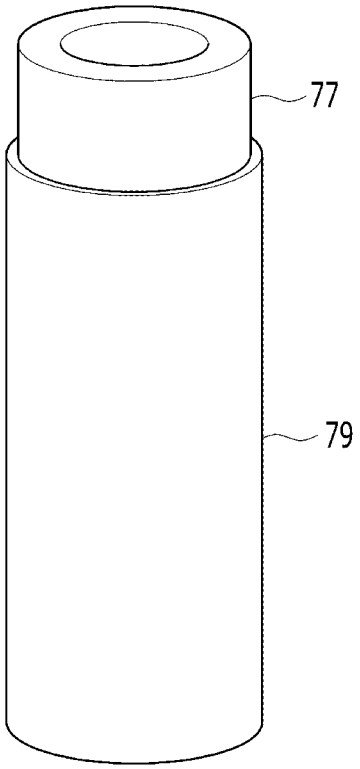
Figure 15:
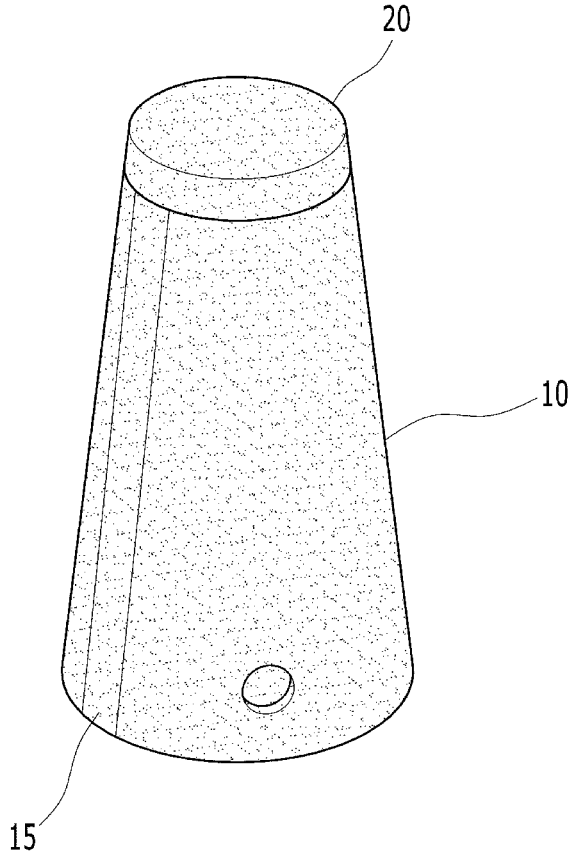

Method of Preliminarily Molding a Metal Foam Cap and Manufacturing a Cone Assembly FIG. 12 is a view illustrating a process of preliminarily molding a circumferential portion of the metal foam cap by disposing a metal foam cap 75 on the lower punch 73 having a protruding portion that has a diameter less than a diameter of the cap, and then pressurizing the metal foam cap 75 using the upper punch 71, and by bending the circumferential portion of the metal foam cap 75. Here, the upper punch 71 is formed with a tapered recess portion that has a diameter equal to or greater than the diameter of the metal foam cap and of which the diameter decreases while getting closer to an inside FIGS. 13 to 15 are views illustrating a process of manufacturing a metal foam cone assembly by mounting the aforementioned metal foam cone to the assembly jig 79 and then pressurizing the metal foam cone using the upper punch 77 to overlap the metal foam cone and the metal foam cap. FIG. 15 is a view illustrating the manufactured metal foam cone assembly.

EXAMPLE 3

Method of Combining a Metal Foam Cone Assembly and a Metal Connector

A slurry (paste) in which the nickel-based powder and the polyvinylpyrrolidone solution are mixed is applied to a combining portion of the metal foam cone assembly and the metal connector, and the metal foam cone assembly is mounted to a metal connector assembly jig and thereby is combined with the metal connector.

By applying the powder slurry and then sintering the metal foam cone assembly combined with the metal connector, the metal foam cone assembly stably combined with the connector may be manufactured.

Figure 16:
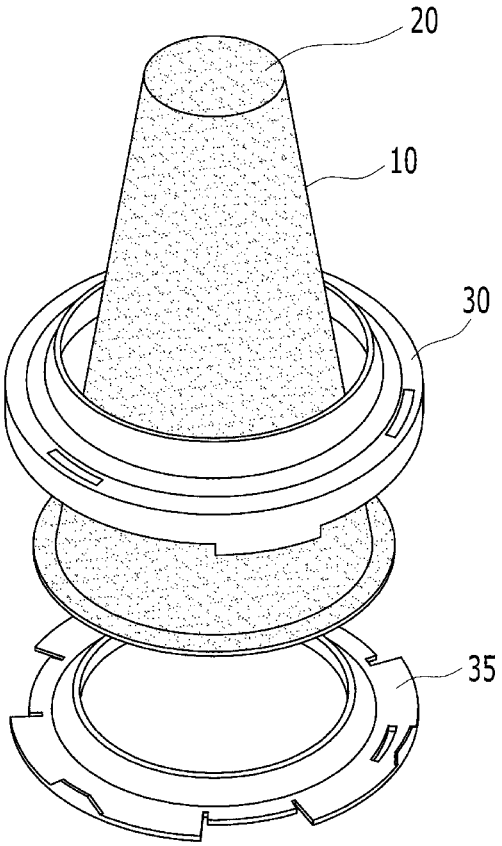
FIGS. 16 to 18 are views illustrating a process of mechanically combining a metal connector, a metal foam assembly, and an inner ring by introducing the inner ring.
Figure 17:
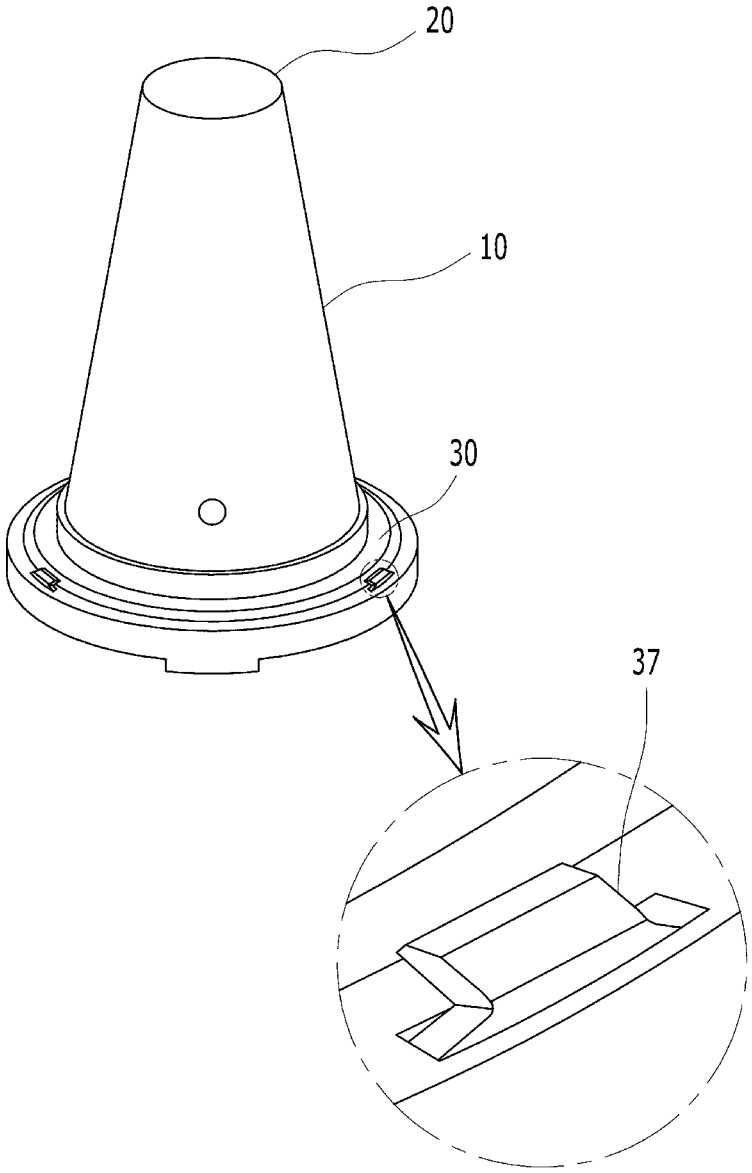
Figure 18:
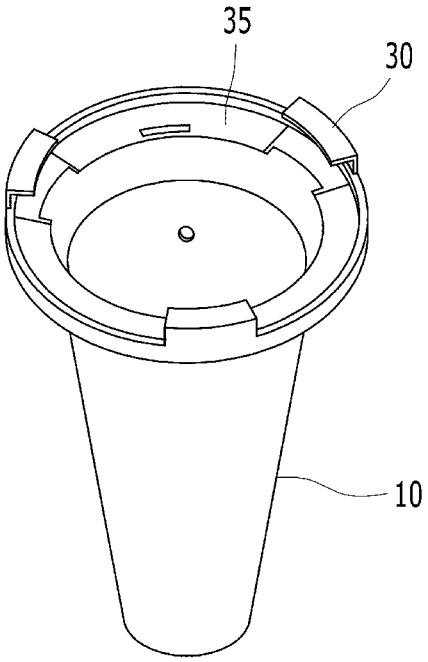

FIGS. 16 to 18 are views illustrating a state in which the metal connector 30 is stably combined with the metal foam cone assembly by introducing the inner ring 35, disposing the inner ring 35 between the metal foam cone assembly and the metal connector 30, forming the protruding portion 37 on the surface on which the inner ring 35 contacts with the metal connector 30, forming a hole in the metal connector 30 that contacts with the inner ring 35, combining the metal foam cone assembly, the inner ring 35, and the metal connector 35, and pressurizing the protruding portion 37 of the inner ring 35, thereby making the metal connector 30 contact with the inner ring 35 in a state in which the protruding portion 37 is pressurized to the metal connector 30.

Further, by combining the metal foam cone assembly, the inner ring 35, and the metal connector 30, and then spot welding a contact portion between the inner ring 35 and the metal connector 30 along the circumferential portion of the inner ring 35, the metal foam cone assembly combined with the metal connector 30 is manufactured.

Even though exemplary embodiments of the present invention are described with reference to the accompanying drawings, those skilled in the art may understand that the exemplary embodiments may be implemented in other specific embodiments without changing the technical spirit or essential features of the present invention.

Accordingly, the aforementioned exemplary embodiments are only examples in every aspect and thus, are to be understood not to be limitative. The range of the present invention is to be defined by the claims rather than by the detailed description. All of the modifications or modified forms induced from the meaning and range of the claims and the equivalents thereof are to be interpreted to be included within the scope of the present invention.

The invention claimed is:

1. A method of manufacturing a metal foam cone assembly, the method comprising:

manufacturing a metal foam cone;

mounting the metal foam cone to an assembly jig;

manufacturing a metal foam cap;

disposing the metal foam cap in an upper portion of one end of the metal foam cone;

physically overlapping and thereby combining the metal foam cone and the metal foam cap by pressurizing the metal foam cap using an upper punch, and combining a metal connector with one end of the metal foam cone assembly, wherein the step of manufacturing the metal foam cone comprises providing a porous metal foam sheet, cutting the porous metal foam sheet to be in a predetermined shape using a cutting press that is provided with a knife tool, disposing the cut metal foam sheet on a base plate of a forming die and then primarily forming the metal foam sheet using a mandrel of a cone shape, secondarily forming the metal foam sheet using a left slider and a right slider of the forming die and pressing an overlapping portion of the metal foam sheet using a stamping jig of the forming die after the forming using the left and right sliders, and wherein the step of manufacturing the metal foam cap comprises providing a porous metal foam sheet, cutting the porous metal foam sheet to be in a circular shape using a cutting press that is provided with a knife tool, disposing the circular metal foam sheet on a cap forming die that is mounted with an upper punch and a lower punch and preliminarily molding the circular metal foam sheet by pressurizing the upper punch with respect to the lower punch.

2. The method of claim 1, wherein:

the metal connector is combined using a connector assembly jig after applying a powder paste of powder and binder solution to the metal foam cone assembly and the metal connector and then is sintered.

3. The method of claim 1, wherein:

the metal connector is combined by engaging and then pressurizing one end of the metal foam cone assembly between an inner ring and the metal connector.

4. The method of claim 1, wherein:

the metal connector is combined using spot welding after engaging one end of the metal foam cone assembly between an inner ring and the metal connector.

* * * * *